United States Patent [19]

Wilkinson

[11] Patent Number: 4,681,010

[45] Date of Patent: Jul. 21, 1987

[54] MULTIDIRECTIONALLY ADJUSTABLE VIBRATO DEVICE

[76] Inventor: Trevor A. Wilkinson, 1075 State St., A201, Redlands, Calif. 92373

[21] Appl. No.: 907,892

[22] Filed: Sep. 16, 1986

[51] Int. Cl.[4] ..... G10D 3/04

[52] U.S. Cl. ..... 84/298; 84/297 R; 84/299; 84/313

[58] Field of Search ..... 84/298, 299, 307, 313

[56] References Cited

U.S. PATENT DOCUMENTS

| | | | |
|---|---|---|---|
| 3,178,985 | 4/1965 | Jeranson | 84/307 |
| 3,290,980 | 12/1966 | Fender | 84/307 |
| 4,171,661 | 10/1979 | Rose . | |
| 4,248,126 | 2/1981 | Lieber | 84/299 |
| 4,361,068 | 11/1982 | Schaller | 84/299 |
| 4,487,100 | 12/1984 | Storey | 84/299 |

*Primary Examiner*—Lawrence R. Franklin

*Attorney, Agent, or Firm*—Weissenberger & Peterson

[57] ABSTRACT

A vibrato device for guitars which is easily omnidirectionally adjustable by a clamp screw and a pivot screw concentric therewith, both conveniently accessible from the rear of the device, and by elevation screws mounted in the string-supporting saddles and conveniently accessible from the top of the device. The brass saddles are provided with a steel block insert for improved resonance and damping, and the control lever can be conveniently either locked in one position, or allowed to swing freely, at any time during play. The device is provided with self-centering straight knife-edge bridge pivots. The free ends of the strings are clamped to the bottom of a steel sustain block depending from the bridge of the device, and the clamp screws for both the strings and the lateral saddle position adjustment are turnable with coins.

6 Claims, 12 Drawing Figures

FIG. 10
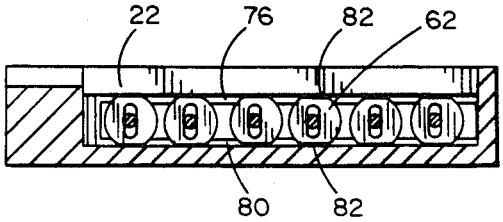
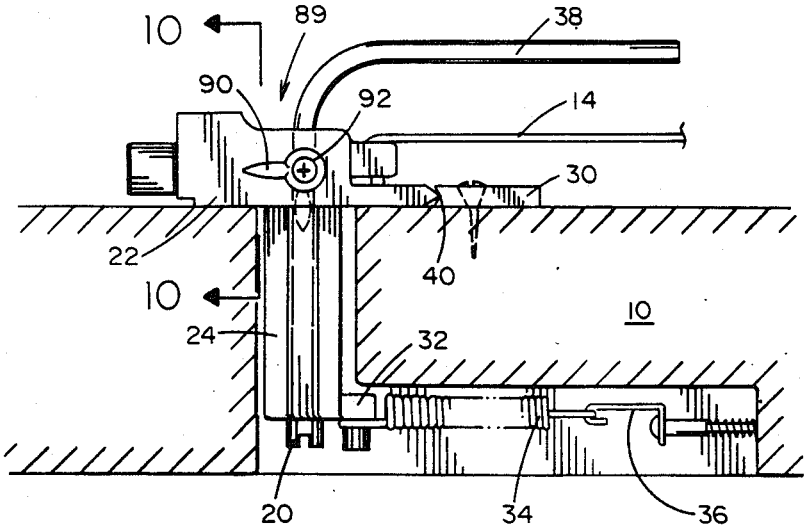
FIG. 11
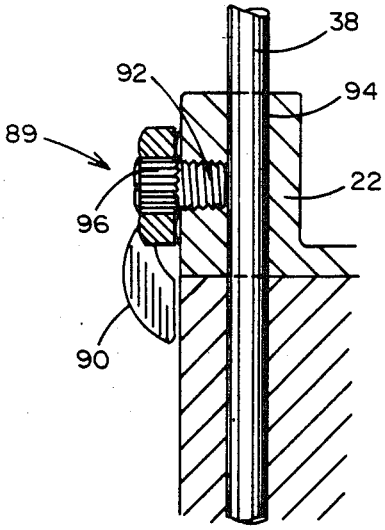
FIG. 12

MULTIDIRECTIONALLY ADJUSTABLE VIBRATO DEVICE

This invention relates to a vibrato device for guitars, and more particularly to a device which provides an improved clarity of tone and improved multidirectional adjustability.

BACKGROUND OF THE INVENTION

Vibrato systems for guitars are well known as shown, for example, in U.S. Pat. No. 4,171,661. These systems are generally sold as an attachment to existing guitars and can be operated by way of an actuating lever to simultaneously relax the tension of all the strings of the guitar to a small degree, thereby detuning it slightly.

Existing vibrato systems have the disadvantage of being difficult to adjust for various string spacings, and producing a harsher sound than desirable. Furthermore, a number of guitarists consider it desirable to have the opportunity of leaving the actuating lever in a forward position between uses, or to have it swing out of the way under its own weight whenever it is not in use.

SUMMARY OF THE INVENTION

The present invention overcomes the problems of the prior art by providing a vibrato system in which each of the individual string guides or saddles are easily and independently adjustable transversely of the guitar to allow adjustment of the individual spacings of the strings. This adjustment is accomplished by an arrangement in which the string-carrying saddle is pivotable vertically about the head of a longitudinal adjustment screw mounted concentrically, and constrained by a vertical slot, within a lateral adjustment clamping screw. The tone of the system is improved by the use of a steel string guide insert in each of the brass saddles. In accordance with another aspect of the invention, the actuating arm can be selectively, by a flick of the finger, either locked in a predetermined position with respect to the vibrato device, or unlocked so that it can freely swing to a position dictated either by gravity or by the player as the vibrato device is being used.

BRIEF DESCRIPTION OF THE DRAWINGS

FIG. 10 is a vertical section along line 10—10 of FIGS. 3 and 8;

FIG. 11 is a right side elevation of the device of FIG. 3; and

FIG. 12 is a detail vertical section of the locking device shown in FIG. 11.

DESCRIPTION OF THE PREFERRED EMBODIMENT

Figure 1:
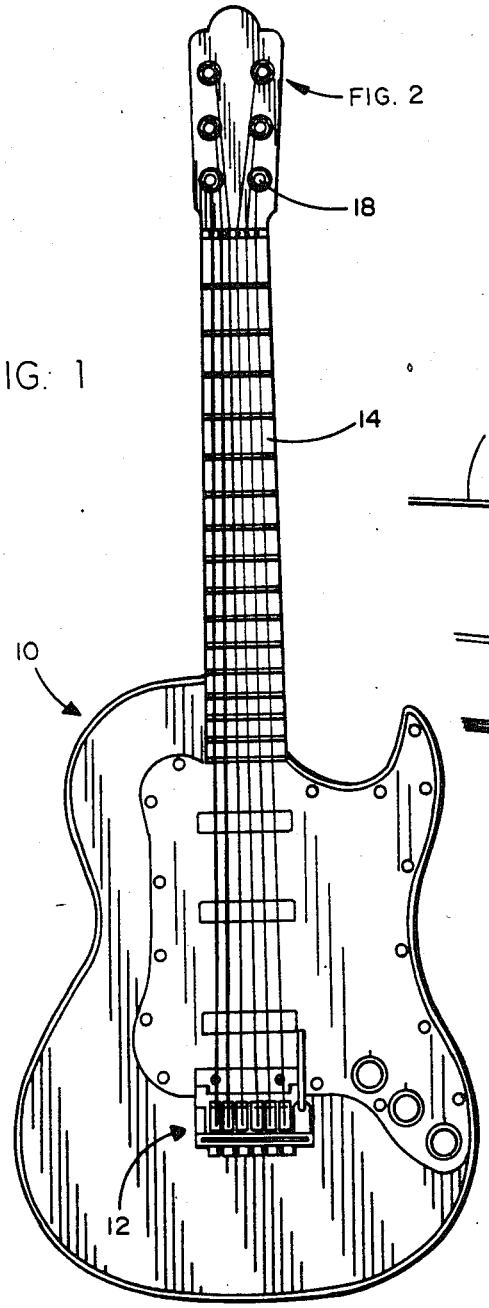
FIG. 1 is a plan view of a guitar equipped with the vibrato device of this invention.
Figure 2:
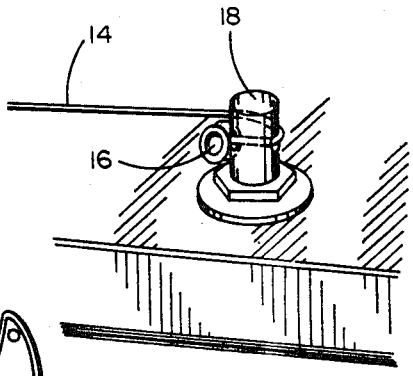
FIG. 2 is a detail perspective view of one of the keys of the guitar of FIG. 1 showing the attachment of the string thereto.

FIG. 1 shows guitar 10 of conventional construction to which the vibrato device 12 of this invention has been attached. It will be noted in the detail of FIG. 2 that when the vibrato system of this invention is used, the strings 14 are strung in the opposite direction from normal, i.e. with the ball end 16 at the tuning key 18 rather than on the body of the guitar. The reason for this arrangement is that when a vibrato device is used, the strings are periodically relaxed and tightened. If the strings are strung in the normal way, with their free ends wound around the tuning key 18 in multiple turns, the action of the vibrato device gradually shifts the position of the string windings on the tuning key with respect to one another, resulting in a slight detuning of the instrument.

Figure 4:
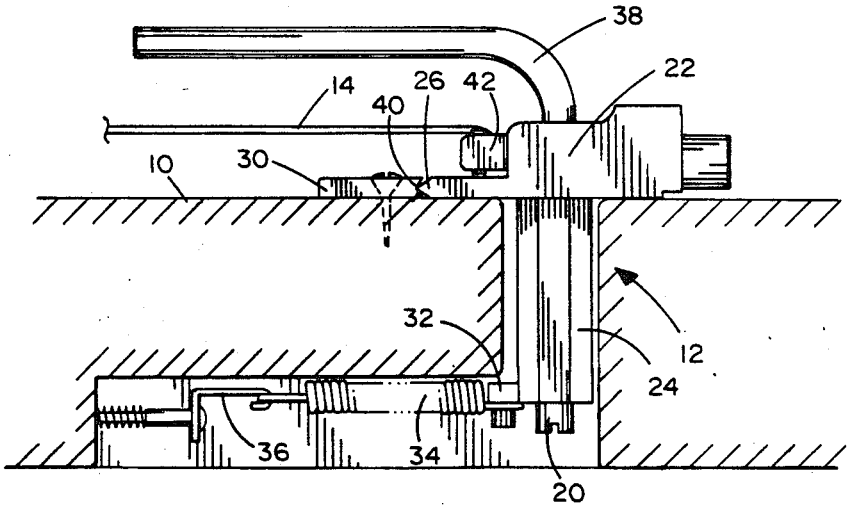
FIG. 4 is a side elevation of the device of FIG. 3.
Figure 8:
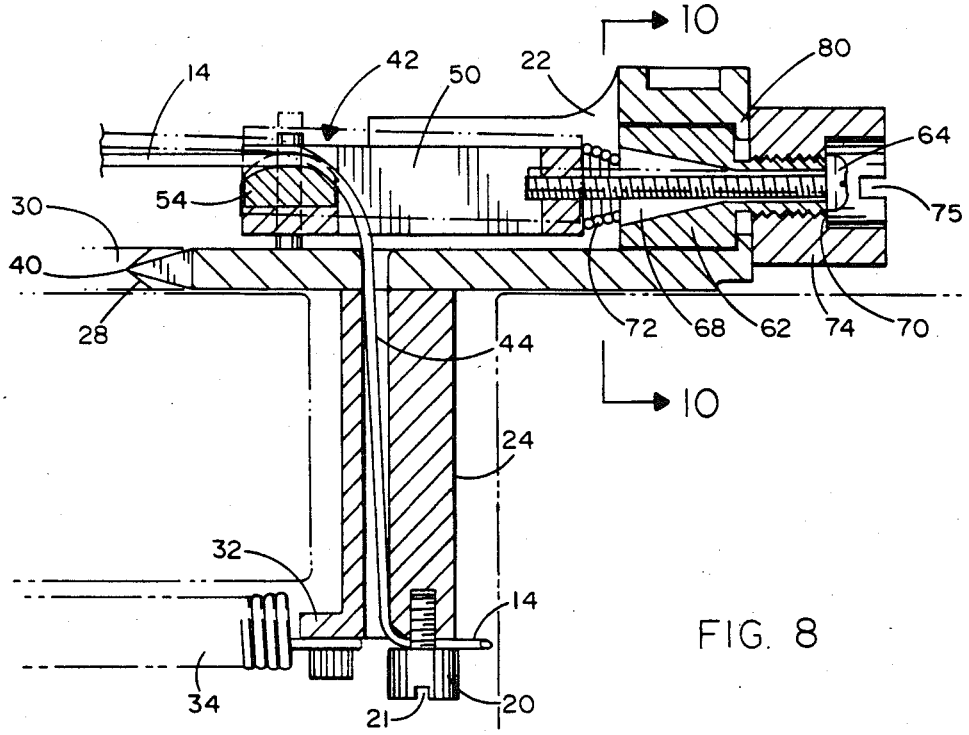
FIG. 8 is a vertical section of the vibrato system of FIG. 3.
Figure 9:
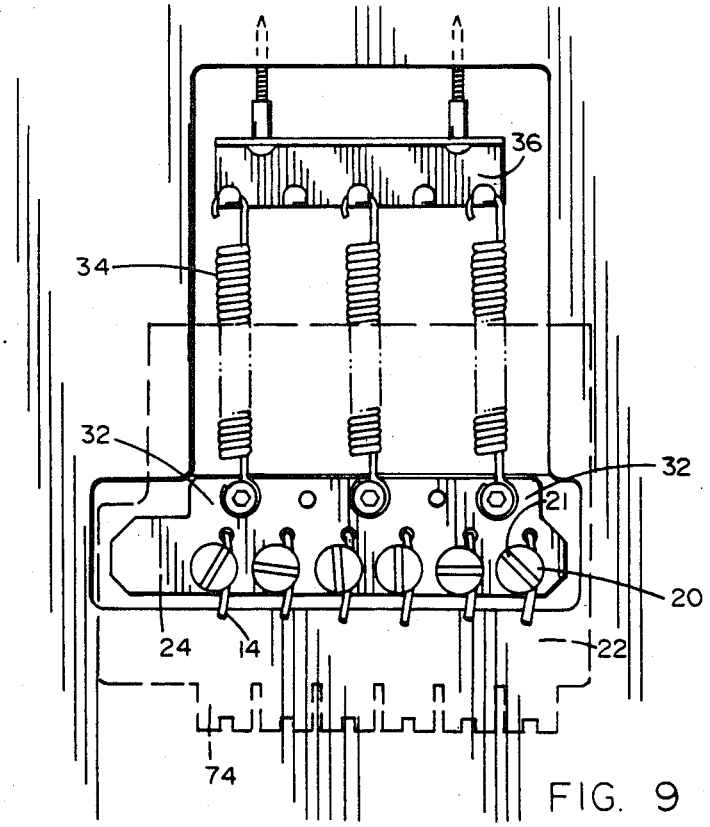
FIG. 9 is a bottom view of the device of FIG. 3.

By winding the free ends of the strings 14 around the retaining screws 20 at the bottom of the vibrato device 12 as shown in FIGS. 4, 8 and 9, it is possible to tune the guitar with only about one-half of a turn of the string 14 around the key 18, thus eliminating the abovementioned source of undesired detuning. The heads of the retaining screws 20 are preferably provided with slots 21 wide enough to receive a coin for tightening or loosening the screws 20.

Figure 3:
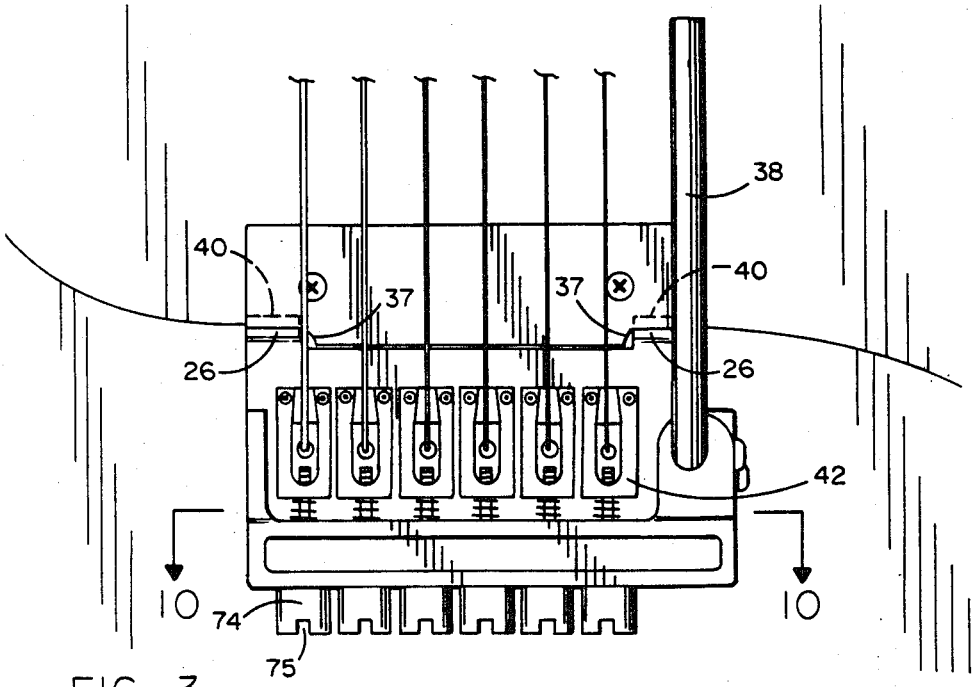
FIG. 3 is a plan view of the vibrato device of this invention.

As best shown in FIGS. 3 and 4, the vibrato device 12 consists of a bridge 22 and a steel sustain block 24 integrally attached thereto and depending therefrom. At its forward end, the bridge 22 has knife-edge protrusions 26 which engage V-notches 40 in a bearing 30 attached to the upper surface of the guitar 10. The sustain block 24 carries on its underside a plate 32 which is pulled toward the left in FIG. 4 by springs 34 attached to a bracket 36 fixed to the underside of the guitar 10. It is important that the ends of the springs 34 be firmly attached to the plate 32 of the sustain block 24 so that the ends of the springs 34 cannot change their position with respect to the sustain block 24 in the slightest during play. This prevents unintended detuning of the guitar. (The attachment of the other end of springs 34 is not critical as those ends do not move significantly during play.)

The curved edges 37 of V-notches 40 assist in centering the bridge 22 with respect to bearing 30 without interfering with the free movement of knife edge 26 about the transverse horizontal pivot axis defined by it. The straight shape of knife edge 26 prevents the binding and misadjustment observed with the conventional screwhead pivot bearings of the prior art.

Normally, the tension of the spring 34 and the strings 14 is such as to maintain the bridge 22 in equilibrium in a horizontal position in FIG. 4. By manipulating the control arm 38, the guitarist can cause the bridge 22 to pivot about the knife-point edge 40 so as to temporarily relax the tension in the strings 14 to change the tone of the guitar. By appropriately manipulating the control of arm 38, an alternating tensioning and relaxing of the strings 14 can be achieved so as to produce a vibrato effect. When the control arm 38 is released, the vibrato device 12 returns to its equilibrium position in which the guitar 10 is exactly in tune.

As best shown in FIGS. 3 and 8, the strings 14 are individually threaded over guide blocks 54 of saddles 42, and through string channels 44 in the balance block 24, to be tied down at the retaining screws 20.

Figure 5:
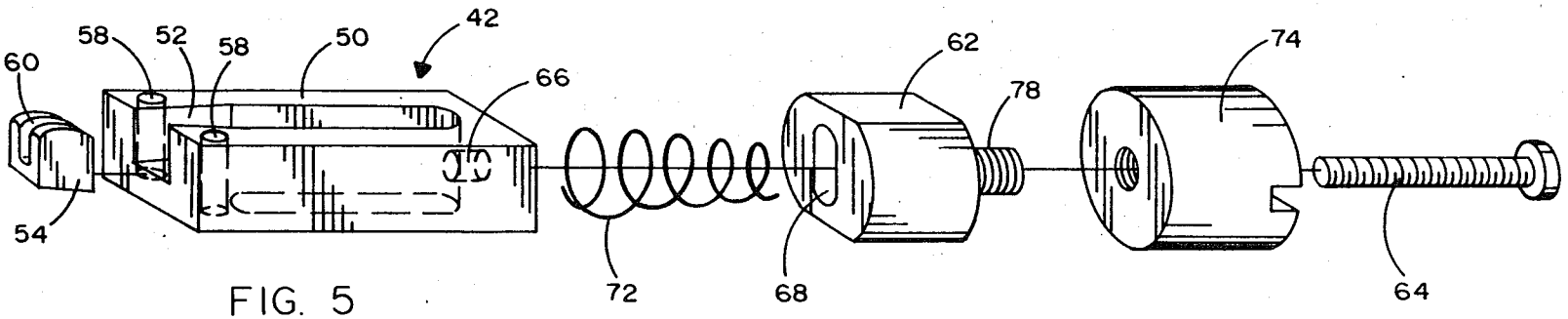
FIG. 5 is an exploded view of one of the adjustable saddles of the device of FIG. 3 and the adjustment therefor.
Figure 6:
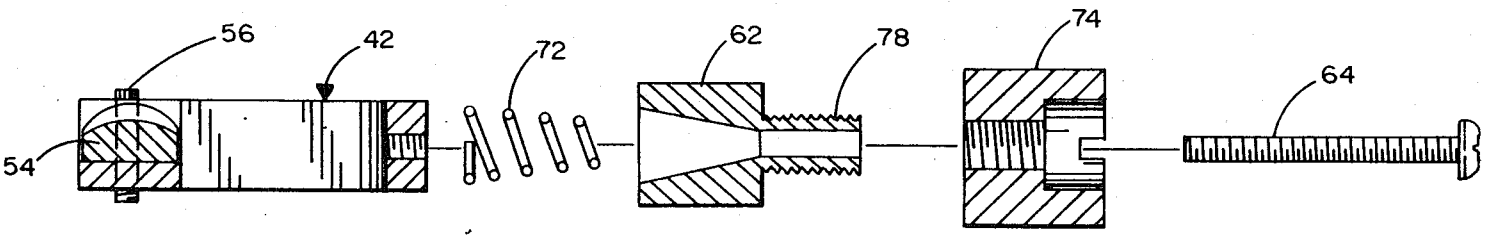
FIG. 6 is an exploded vertical section of the parts shown in FIG. 5.
Figure 7:
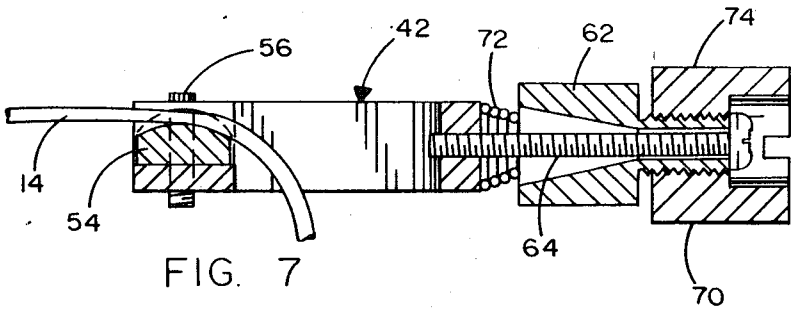
FIG. 7 is an assembled vertical section of the parts shown in FIGS. 5 and 6.

In accordance with this invention, the saddles 42 can be independently moved in two horizontal and one vertical direction to accommodate various string heights and string spacings by means of the mechanism depicted in detail in FIGS. 5 through 7.

Turning first to FIG. 5, one of the saddles 42 is shown in detail in this exploded view. The saddle 42 consists of a hollow brass body 50 which is cut out at the front, as at 52, to receive a steel guide block 54. It is well known among guitar manufacturers that the use of steel at the points of attachment of strings gives a guitar a desirable resonance; however, the use of an excessive amount of steel results in excessive resonance which must be attenuated by the interposition of a less resonant vehicle between the steel guide block 54 and the base of the bridge 22. This problem had previously been solved by mounting a flexible sheet steel string support on a brass base, but it was found that this expedient tended to result in an eventual detuning of the guitar. In accordance with the present invention, a solid steel guide block 54 is inserted into the front end of the saddle. The solid nature of guide block 54 avoids deformation and maintains its position with respect to the body 50 of the saddle 42. In this manner the string 14 is firmly held in place on the resonant guide block 54, yet the material of the brass saddle 42 is interposed completely between the guide block 54 and the steel sustain block 24.

The vertical position of the saddle 42 can be adjusted to conform to the desired heights of the strings 14 above the guitar's finger board by means of elevation screws (FIG. 6), which are threaded into the vertical openings 58 in the saddle body 50. In this manner, as best seen in FIG. 7, the string 14 touches only the guide block 54, whose groove 60 centers string 14, and descends into the balance block 24 (FIG. 4) without touching the body 50 of saddle 42.

The saddle 42 is connected to the spacing block 62 in a vertically free but horizontally restrained manner by the pivot screw 64 which is threaded into the opening 66 of saddle 42. As best seen in FIG. 7, the channel 68 of spacing block 62 is sufficiently high to allow the pivot screw 64 to pivot about point 70 (FIG. 7; see also dot-dash lines in FIG. 8) as the front end of saddle 42 is raised. On the other hand, the width of the channel 68 is essentially the same as the diameter of pivot screw 64, so that the screw 64, and with it saddle 42, cannot move sideways with respect to spacing block 62. The position of saddle 42 can be adjusted in a forward rearward (i.e. axial) direction by tightening or loosening the pivot screw 64 against the bias of spring 72.

The transverse horizontal position of the saddle 42 can be adjusted by loosening the clamp screw 74 and sliding the spacing block 62 transversely on its flat surfaces 82 within the guide-slot 76 formed in the bridge 22 (FIG. 10). For this purpose, the clamp screws 74 are preferably provided with a slot 75 of a width suitable to permit the use of a coin for turning the clamp screw 74. Following a transverse horizontal adjustment, the spacing block 62 can be fixed in place by tightening the clamp screw 74 on the screw thread 78 of spacing block 62 so as to pinch the shoulder 80 (FIG. 8) between the clamp screw 74 and the spacing block 62. It will be noted that the clamping of clamp screw 74 does not affect the vertical mobility of pivot screw 64, which remains freely vertically movable at all times. Saddle 42 is held down against the bridge 22 by the tension of the string 14.

FIGS. 8 and 9 illustrate the routing of strings 14 over the guide blocks 54 and down through individual channels 44 to the retaining screws 20 on the underside of the balance block 24. It will be seen that in this manner, the string 14 contacts only steel portions of the vibrato device, while any resonance resulting therefrom is attenuated by the interposition of the brass saddle 42 between the string and the base of the bridge 22. By tightening the free end of the string 14 on the vibrato device while positioning their ball ends at the keys on the neck of the guitar, detuning of the guitar by repeated operation of the vibrato device is effectively avoided.

FIGS. 11 and 12 illustrate another feature of this invention. It is sometimes convenient for a guitarist to have the control arm 38 in a position pointing toward the neck of the guitar where it can be readily grasped for the operation of the vibrato device 12. At other times, the same guitarist may want the control lever 38 completely out of the way so as not to interfere with the ordinary playing of the guitar. The present invention makes it possible to rapidly switch between these two conditions by providing a control lever lock 89. A locking lever 90 is attached to a locking screw 92 in such a manner as to allow the control lever 38 to turn freely within the bore 94 in bridge 22 when the locking lever 90 is in the down position shown in FIG. 12 (and in dotted lines in FIG. 11), while locking the control lever 38 against rotation within the bore 94 when the locking lever 90 is in the horizontal position as shown in solid lines in FIG. 11. In order to allow this rather sensitive adjustment, the locking lever 90 and screw 92 are preferably two pieces releasably interconnected by serrations 96 which allow the relative positions of screw 92 and locking lever 90 to be varied for an accurate adjustment.

With this arrangement, the guitarist may bring the lever 90 to a horizontal position as long as he wishes to use the vibrato devices, and he can then flip it to the vertical position with a quick and simple flick of the finger. With the locking lever 90 in the vertical positions of FIGS. 11 and 12, gravity will cause the control lever 38 to pivot within the bore 94 to a position transverse of the vibrato device 12 when the guitar is held in its normal playing position against the guitarist's body.

I claim:

1. A vibrato device for guitars, comprising:

(a) a bridge;

(b) a plurality of string-supporting saddles mounted on said bridge for limited omnidirectional movement with respect thereto;

(c) a plurality of slotted spacing blocks slidably movable transversely with respect to said bridge;

(d) a plurality of clamp screws; and (e) a plurality of pivot screws;

(f) said clamp screws cooperating with said spacing blocks to selectively clamp said spacing blocks to said bridge;

(g) each of said pivot screws passing axially through one of said clamp screws and through said slot in one of said spacing blocks to engage one of said saddles;

(h) said slot being so shaped as to prevent transverse movement of said pivot screw therein but allowing free vertical movement thereof; and (i) said saddle being axially movable by rotating said pivot screw, the head of said pivot screw being biased against a vertical interior surface of said clamp screw;

(j) whereby said saddle is pivotally vertically movable about the head of said pivot screw.

2. The device of claim 1, in which said saddle includes elevation screws for limiting the vertical movement of said saddle toward said bridge, said saddle being adapted to be vertically biased toward said bridge by the tension of the guitar string which it supports.

3. The device of claim 1, in which said spacing block has a vertical rear surface and a screwthread extending rearwardly from said surface, said clamp screw has a vertical outer front surface and a screwthread extending forwardly therefrom, said bridge has a pair of spaced vertically extending shoulders, and said spacing block and clamp screw clamp said shoulders between said surfaces when said screwthreads are mated and tightened.

4. The device of claim 3, in which said pivot screw passes freely axially through said screwthreads.

5. The device of claim 3, in which the head of said clamp screw is provided with a slot of sufficient width to receive a coin for turning said clamp screw.

6. The device of claim 1 wherein said bridge is pivotally mounted on said guitar to provide a vibrato effect.

* * * * *

UNITED STATES PATENT AND TRADEMARK OFFICE

CERTIFICATE OF CORRECTION

PATENT NO. : 4,681,010

DATED : 21 July 1987

INVENTOR(S) : Trevor A. Wilkinson

It is certified that error appears in the above—identified patent and that said Letters Patent is hereby corrected as shown below:

Claim 1, line 1 Cancel "vibrato"

Signed and Sealed this

Twelfth Day of April, 1988

*Attest:*

DONALD J. QUIGG

*Attesting Officer*

*Commissioner of Patents and Trademarks*